United States Patent [19]

Sumner et al.

[11] Patent Number: 4,778,009

[45] Date of Patent: Oct. 18, 1988

[54] SHOCK ACTUATED SWITCH FOR PERFORATING GUN ASSEMBLY

[75] Inventors: Cyril R. Sumner, Houston; David R. Warren, Manvel, both of Tex.

[73] Assignee: Halliburton Company, Duncan, Okla.

[21] Appl. No.: 72,493

[22] Filed: Jul. 13, 1987

[51] Int. Cl.[4] ..... E21B 43/116

[52] U.S. Cl. ..... 166/55.1; 166/66; 200/61.01; 89/1.15

[58] Field of Search ..... 166/53, 55, 55.1, 63, 166/65.1, 66; 175/4.51, 4.54; 89/1.15; 200/61.08, 82 R

[56] References Cited

U.S. PATENT DOCUMENTS

| | | | |
|---|---|---|---|
| 3,196,974 | 7/1965 | Barnes, Jr. | 200/61.01 |
| 3,398,803 | 8/1968 | Leutwyler et al. | 166/55.1 X |
| 3,594,745 | 7/1971 | Nickels | 200/82 R X |
| 3,648,785 | 3/1972 | Walker | 166/55.1 X |
| 4,011,815 | 3/1977 | Garcia | 166/55.1 X |
| 4,566,544 | 1/1986 | Bagley et al. | 166/55.1 X |

*Primary Examiner*—Jerome W. Massie
*Assistant Examiner*—Matthew Smith
*Attorney, Agent, or Firm*—William J. Beard

[57] ABSTRACT

For use in a perforating gun assembly which incorporates an explosive for detonation of a string of shaped charges, all the explosive materials forming a significant, violent pressure shock wave propagated up a cased well borehole, a pressure actuated switch includes an enlarged piston having a head exposed to the pressure shock wave, a stem connected to said head, bifurcated fingers capturing a resilient material therebetween to permit flexure, a surrounding sleeve which is made of metal and defined in multiple portions, and a plurality of metal contacts contiguous to said stem and adapted to be selectively contacted by said metal sleeve to either make or break on movement of said piston.

13 Claims, 1 Drawing Sheet

FIG. 1
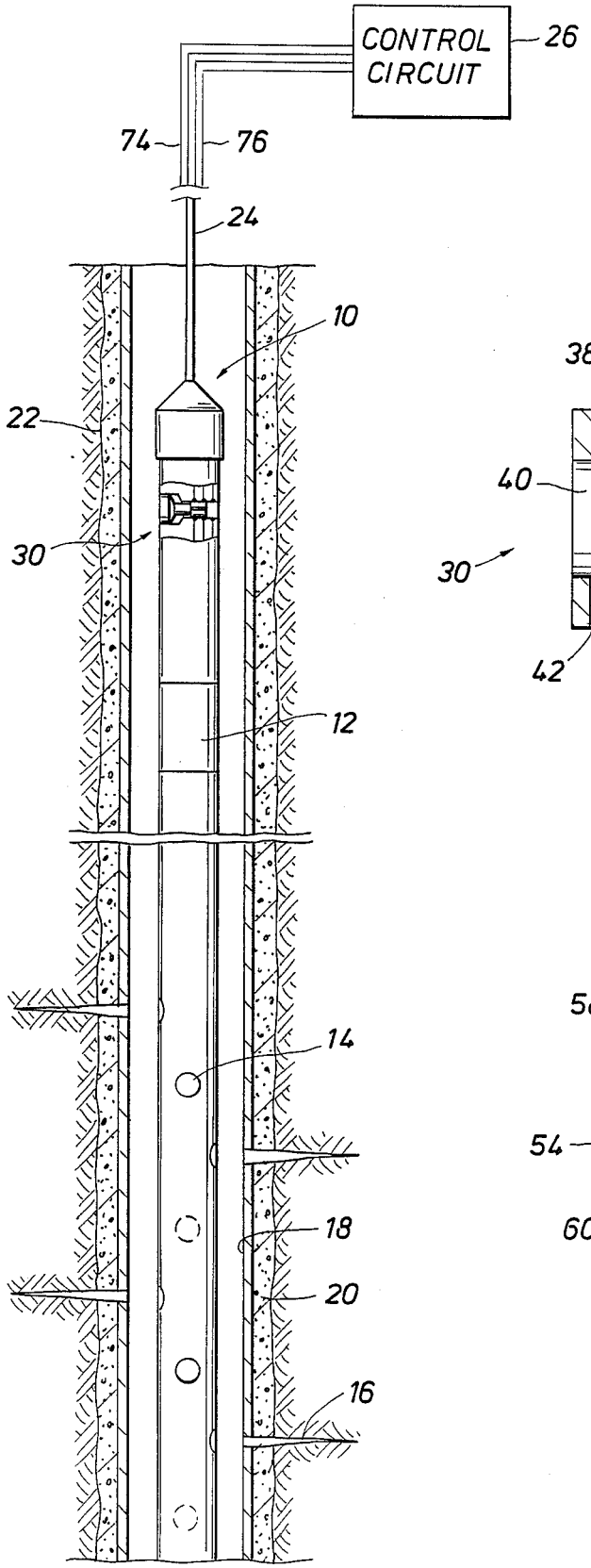
FIG. 2
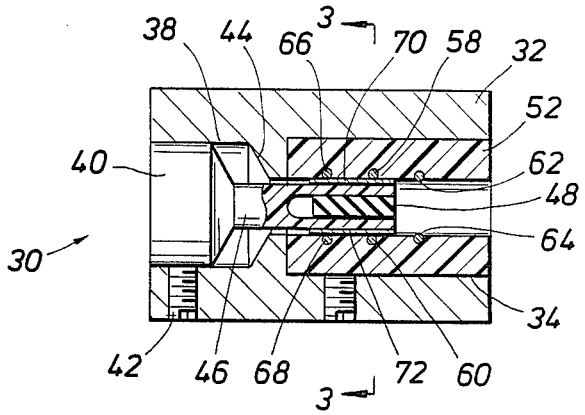
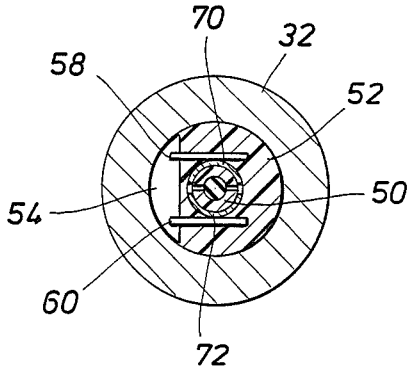
FIG. 3

SHOCK ACTUATED SWITCH FOR PERFORATING GUN ASSEMBLY

BACKGROUND OF THE DISCLOSURE

This disclosure is directed to a shock activated switch which is capable of providing electrical circuit switching. The switch is adapted to be installed in a downhole perforating gun assembly which supports a number of perforating guns. The perforating gun assembly supports a plurality of shaped charges which are used to form perforations into the surrounding pipe, which defines the well, the cement on the exterior and into adjacent formations to produce from productive formations. The perforating gun assembly normally incorporates a number of such shaped charges and they are collectively fired by additional explosives in the perforating gun assembly. A significant shock wave is formed in the confines of the well borehole, the shock wave propagating up the borehole. The shock wave may substantially destroy the operating equipment that is included in the perforating gun assembly. It is particularly important to have equipment in the perforating gun assembly which is able to withstand this shock wave. It is important so that signals can be conveyed from the perforating gun assembly back to the well surface so that the operator knows the operative state of the equipment. One important signal which is required is the signal that firing has actually occurred.

The present apparatus is directed to a pressure responsive switch. It is exposed to the shock wave created by the explosion of the shaped charge in the well borehole. Moreover, the switch is intentionally exposed to this high pressure shock wave so that surface personnel and provided with switch initiated signals to identify the actual moment or instant of firing. This is therefore a rugged, difficult environment in which to expect a pressure operated switch to operate properly. The present apparatus provides such safe operation and is particularly able to transmit the requisite electrical signal notwithstanding the fact that the switch itself may be destroyed by the shock wave originating in the narrow confines at the location of the perforating gun assembly.

The present apparatus is surprisingly and particularly simple in construction so that it has only a single moving assembly. This moving assembly can be treated as a sacrificial member. In other words, it is not necessary to be used again and again. Rather, it may be destroyed in the violence of the explosion, but it will, even in its own destruction, provide the necessary signal through electrical conductors connected to the surface which indicates that the firing has actually occurred. This therefore is a highly reliable switch which forms the electrical signals of interest. The present apparatus includes a movable switch element which will be described as the piston operated, stem mounted actuator. It is cooperative with a sleeve which is positioned in the perforating gun assembly having a countersunk and undercut hole therein. The sleeve is fixed in location. It is constructed so that it can make one circuit on movement and break another circuit at the same instant. In this arrangement, the event of interest (detonation of explosives) can be signaled either by the make or break which occur on actuation.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 shows a pressure actuated switch in accordance with the present disclosure installed in the perforating gun assembly positioned in a well borehole;

FIG. 2 is an enlarged sectional view through the pressure actuated switch of the present disclosure showing a piston operated actuator with contacts; and FIG. 3 is a sectional view along the line 3—3 of FIG. 2 showing internal details of construction.

DETAILED DESCRIPTION OF THE PREFERRED EMBODIEMENT

Attention is first directed to FIG. 1 of the drawings where the present apparatus is shown installed in a perforating gun assembly 10. That assembly includes an elongate body which houses an explosive initiator at 12. There are a number of shaped charges therebelow at 14. The shaped charges are numerous, and are arranged to form perforations 16 which extend through the casing 18 and cement 20 which form the well borehole 22. The well 22 is drilled to any depth, and the perforating gun assembly 10 is lowered on a suitable cable 24 into the well borehole 22. Opposite a formation of interest, the perforating gun assembly is held at that depth on the cable 24, and suitable control circuits 26 are operated to deliver electrical firing signals over the conductor 24. These signals are provided over one or more electrical conductors encased in the armored cable 24.

In operation, the electrical signals are delivered through the armored cable 24. When the signals are received at the perforating gun assembly 10, the shaped charges 14 are fired, forming jets which perforate or cut through the materials into the formation of interest. Production into the well borehole is then achieved. As will be understood, this involves a violent explosion in the narrow confines of the cased well borehole 22. The small confine is extremely constricted. A pressure shock wave is thus propagated upwardly and downwardly. The present invention contemplates the installation of a pressure responsive switch 30 at some location on the perforating gun assembly 10. As illustrated in FIG. 1 of the drawings, it is exposed to the space within the well borehole 22 and on the interior of the casing 18 to observe and respond to the pressure shock wave. The pressure shock wave is also propagated on the interior of the perforating gun assembly 10. An alternate mode of installation is to position the switch 30 where it is exposed to pressure on the interior of the tool. However, pressure on the exterior of the tool is equally effective for the purpose of forming the necessary signal in response to pressure.

In FIG. 2 of the drawings, the pressure actuated switch 30 of the present disclosure showing greater detail. It comprises a surrounding cylindrical body 32. This body is drilled with a passage 34 at one end. A similar passage 38 is formed at the opposite end, and the two are connected together. The numeral 40 identifies the enlarged piston which is used to sense response. It has an enlarged face or area which is exposed to the pressure shock wave of interest. As noted above, this can be positioned where it can be triggered by the shock wave traveling on the exterior of the assembly 10 or up the interior. The piston 40 is locked in place by a set screw 42. The screw 42 is incorporated to lock the piston and to that end, it is held against the piston. It is not embedded in the piston to totally forbid movement. Rather, it serves as an adjustable means for retaining the piston in the illustrated position.

The piston 40 is not as long as the drilled passage 38. Rather, it is shorter so that it permits a stroke of controlled length. The stroke which is permitted is defined in part by the shoulder 44 in the passage 38. Thus, the piston travels until it abuts the shoulder 44.

The piston supports a stem 46. The stem 46 is affixed to the piston and supports additional components as will be described. One of the components is the central resilient plug 48. The plug 48 is made of resilient material so that it can be squeezed and collapsed. The stem 46 terminates in a pair of bifurcated fingers 50 best shown in FIG. 3 of the drawings. The fingers are able to flex because they are separated by a diametric split along the stem. The two fingers can thus flex toward one another. The fingers are ideally approximately 180° in curvature save and except the defined slots between the two fingers as shown in FIG. 3. So to speak, the fingers are flexible and pivot by bending toward one another.

The present apparatus further includes a sleeve of cylindrical construction identified at 52. It is circular as shown in FIG. 3 except that a portion is cut away to define a chamber 54. The chamber 54 serves as an area where appropriate wiring connections can be made. These wiring connections utilize several conductive pins to be described. The cylindrical plug 52 is made of non conducting material, a suitable material being some type of elastomeric which is an electrical insulator.

The pins illustrated in the preferred embodiment are all made of conducting material. Two of these pins are identified by the numerals 58 and 60. They are additionally shown in FIG. 2 of the drawings where additional pins 62 and 64 are shown. Last of all, there are pins 66 and 68. The six pins comprise three pair of pins. They are parallel to one another and are received in drilled passages through the plug 52 which position the pins so that they might be contacted by a metal sleeve. In fact, the present apparatus is constructed with two separate halves which together form the metal sleeve. In FIG. 2 of the drawings, the pins 58, 62, and 66 are selectively contacted by a metal sleeve 70 and the other pins are selectively contacted by a metal sleeve 72. The two sleeves together comprise the surrounding sleeve. They are again approximately 180° to encompass the central stem. The sleeves however are electrically isolated from one another so that they do not touch as best shown in FIG. 3. So to speak, the two sleeves are really in fact halves which face one another.

The present apparatus is used and operated in the following fashion. Assume that the conductor 74 is to be switched off at detonation while the conductor 76 is to be switched on at detonation. Assume that the conductor 74 is connected through the pins 58 and 66 as shown in FIG. 2 of the drawings. At the time of detonation, the piston 40 is pushed into the recess provided for it until it abuts the shoulder 44. In the example just given, the conductor 74 is wired through the pins 58 and 66. This circuit is broken because it is bridged by the metal sleeve 70. Movement of that sleeve breaks the circuit connection. Indeed, it then connects the pin 58 with the pin 62. When this occurs, the movement of the piston 40 serves as a signal to the surface via the conductor 74.

Assume also that the conductor 76 is connected in this exemplary configuration through the pins 60 and 64. As initially deployed, no connection is made. But, after detonation and movement of the piston 40, the contact sleeve 72 is then moved into proximity bridging the two pins and thereby completing the connection so that a signal is formed on the conductor 76. In this arrangement, different combinations of the pins can be used. For instance, the switch will function as a single pole, single throw switch. It will function also as two single pole, single throw switches. In fact, the center pin on either side can be switched between make and break connections if so desired. Suffice it to say, the present apparatus is able to provide proper indication of operation either on the make or break.

The switch construction set forth in FIGS. 2 and 3 is particularly able to withstand the explosive impact. The wires on the interior which connect with the pins are shielded in the cavity 54. The explosion may be so violent that the piston is destroyed. Even so, that poses no particular problem because the stem is pushed to achieve the electrical contact as required and thereby form the necessary electrical signals for the control circuitry.

Important features of the present apparatus include the ability to be selectively wired in various configurations through the use of the split sleeve construction. That is, the present apparatus is a single switch or can serve as multiple switches depending on requirements.

An alternate construction involves positioning the piston 40 facing downwardly on the interior of the tool. There is a tremendous shock wave which travels up the tool. The shock wave is sufficient to actuate the switch even when positioned on the interior.

While the foregoing is directed to the preferred embodiment, the scope thereof is determined by the claims which follow.

What is claimed is:

1. A pressure actuated, shock wave responsive switch installed in a perforating gun assembly for use in detonating shaped charges carried by the perforating gun assembly, the switch comprising:

(a) a supporting housing installed on a perforating gun assembly;

(b) an exposed piston means having an exposed face which is supported by said housing wherein said face is directed to receive impact of a pressure shock wave occurring on detonation of shaped charges supported by the perforating gun assembly in the close confines of a well borehole;

(c) stem means supported by said piston and movable therewith;

(d) multiple conductive contacts supported by said housing in spaced relation to one another wherein said contacts are connected in electrical circuitry associated with the perforating gun assembly;

(e) sleeve means supported by said stem means controllably making or breaking contact with said electrical contacts wherein said piston means, stem means and sleeve means move as a unit on the explosion of the shaped charges;

(f) hollow contact mounting terminal means;

(g) wherein said conductive contacts are inserted into said terminal means; and (h) wherein said sleeve means is mounted for contact against a first set of said contacts prior to explosion and a different set of said contacts after explosion.

2. The apparatus of claim 1 wherein said stem means is formed of resilient material and is able to flex such that said sleeve means rides past at least one of said electrical contacts.

3. The apparatus of claim 1 wherein said stem means supports two separate sleeve means, said sleeve means being positioned to contact respective contact pairs for each of said sleeve means and further including resilient means enabling said sleeve means to flex during movement.

4. The apparatus of claim 3 wherein said sleeve means together comprise an encircling sleeve split into two separate portions.

5. The apparatus of claim 4 wherein said stem means comprises bifurcated flexible fingers.

6. The apparatus of claim 5 including a set screw for fastening said piston means prior to movement thereof to controllably retard movement of said piston means.

7. The apparatus of claim 1 wherein said stem means includes a pair of elongate bifurcated fingers capturing a resilient plug therebetween to permit flexure of said fingers, and further including separate metal semiconductor sleeve portions thereabout which encompass less than the full circumference therearound and said sleeve portions are maintained in a non-touching concentric relationship.

8. A pressure actuated, shock wave responsive switch installed in a perforating gun assembly for use in detonating shaped charges carried by the perforating gun assembly, the switch comprising:

(a) a supporting housing installed on a perforating gun assembly;

(b) an exposed piston means having an exposed face which is supported by said housing wherein said face is directed to receive impact of a pressure shock wave occurring on detonation of shaped charges supported by the perforating gun assembly in the close confines of a well borehole;

(c) stem means supported by said piston and movable therewith;

(d) multiple conductive contacts supported by said housing in spaced relation to one another wherein said contacts are connected in electrical circuitry associated with the perforating gun assembly;

(e) sleeve means supported by said stem means controllably making or breaking contact with said electrical contacts wherein said piston means, stem means and sleeve means move as a unit on the explosion of the shaped charges;

(f) wherein said stem means includes a pair of elongate bifurcated fingers capturing a resilient plug therebetween to permit flexure of said fingers; and (g) further wherein said sleeve means includes separate metal semiconductor sleeve portions thereabout which encompass less than the full circumference of said stem and said sleeve portions are maintained in a non-touching concentric relationship.

9. The apparatus of claim 8 wherein said stem means is formed of resilient material and is able to flex such that said sleeve means rides past at least one of said electrical contacts.

10. The apparatus of claim 8 including a surrounding hollow contact mounting terminal means wherein said electrical contacts have the form of conductive pins inserted into said terminal means, and said sleeve means is mounted for contact against a pair of electrical contacts prior to explosion and a pair of electrical contacts after explosion.

11. The apparatus of claim 10 wherein said sleeve means together comprise an encircling sleeve split into two separate portions.

12. The apparatus of claim 11 wherein said stem means comprises bifurcated flexible fingers.

13. The apparatus of claim 12 including a set screw for fastening said piston means prior to movement thereof to controllably retard movement of said piston means.

* * * * *